US010144493B2

(12) United States Patent
Edwards

(10) Patent No.: US 10,144,493 B2
(45) Date of Patent: Dec. 4, 2018

(54) FLUID-BASED BUOYANCY COMPENSATION

(71) Applicant: Sea-Bird Electronics, Inc., Bellevue, WA (US)

(72) Inventor: Bradley C. Edwards, Bellevue, WA (US)

(73) Assignee: Sea-Bird Electronics, Inc., Bellevue, WA (US)

( * ) Notice: Subject to any disclaimer, the term of this patent is extended or adjusted under 35 U.S.C. 154(b) by 95 days.

(21) Appl. No.: 15/135,848

(22) Filed: Apr. 22, 2016

(65) Prior Publication Data

US 2016/0229502 A1 Aug. 11, 2016

Related U.S. Application Data

(62) Division of application No. 13/782,971, filed on Mar. 1, 2013, now Pat. No. 9,321,515.

(60) Provisional application No. 61/645,399, filed on May 10, 2012, provisional application No. 61/605,924, filed on Mar. 2, 2012.

(51) Int. Cl.

| | |
|---|---|
| ***B63G 8/14*** | (2006.01) |
| ***B63C 7/10*** | (2006.01) |
| ***B63G 8/24*** | (2006.01) |
| ***B63B 17/00*** | (2006.01) |

(52) U.S. Cl.

CPC ..... *B63G 8/14* (2013.01); *B63B 17/00* (2013.01); *B63C 7/10* (2013.01); *B63G 8/24* (2013.01)

(58) Field of Classification Search

CPC ..... B63C 7/10; B63C 7/12; B63C 2007/125; B63G 8/14; B63G 8/22; B63G 8/24

See application file for complete search history.

(56) References Cited

U.S. PATENT DOCUMENTS

| | | | | |
|---|---|---|---|---|
| 3,334,062 A | | 8/1967 | Brown | |
| 3,520,263 A | * | 7/1970 | Witcher | B63G 8/22 114/331 |
| 4,121,529 A | | 10/1978 | Smith | |
| 4,274,883 A | | 6/1981 | Lumbeck | |
| 4,737,886 A | | 4/1988 | Pedersen | |

(Continued)

FOREIGN PATENT DOCUMENTS

| | | | |
|---|---|---|---|
| GB | 2252082 | A | 7/1992 |
| WO | WO 1992/005567 | A1 | 4/1992 |
| WO | WO 2008/052818 | A1 | 5/2008 |

OTHER PUBLICATIONS

AgileNano, "AgileZorb Technology," 3 pages, 2009.

(Continued)

*Primary Examiner* — Ajay Vasudeva

(74) *Attorney, Agent, or Firm* — Perkins Coie LLP

(57) ABSTRACT

Systems and methods for buoyancy compensation are provided. Both active and passive buoyancy compensation can be provided using a compressible mixture made of a liquid along with a hydrophopic material such as a powder, electrospun fiber, or foam. The compressible fluid compresses as pressure is applied or expands as pressure is released thereby substantially maintaining an overall neutral buoyancy for a vessel. This allows the vessel to ascend and descend to water depths with minimal active buoyancy change. As a result, the energy usage and the reliance on higher pressure air and oils can be minimized.

8 Claims, 7 Drawing Sheets

(56) References Cited

U.S. PATENT DOCUMENTS

| | | | | |
|---|---|---|---|---|
| 4,823,722 | A | 4/1989 | Gass | |
| 5,379,267 | A | 1/1995 | Sparks | |
| 5,460,556 | A | 10/1995 | Logan | |
| 5,486,631 | A | 1/1996 | Mitchnick | |
| 5,496,136 | A * | 3/1996 | Egan | B63C 11/2245 405/186 |
| 5,691,097 | A | 11/1997 | Bortfeldt | |
| 6,021,731 | A | 2/2000 | French | |
| 6,131,531 | A | 10/2000 | McCanna | |
| 6,158,370 | A | 12/2000 | French | |
| 6,321,676 | B1 | 11/2001 | Kohnen | |
| 6,796,744 | B2 | 9/2004 | Jacoway | |
| 6,807,856 | B1 | 10/2004 | Webb | |
| 7,096,814 | B1 | 8/2006 | Webb | |
| 7,112,111 | B1 | 9/2006 | King | |
| 7,131,389 | B1 | 11/2006 | Hawkes | |
| 7,753,754 | B2 | 7/2010 | Curtis | |
| 7,921,795 | B2 | 4/2011 | Imlach | |
| 8,069,808 | B1 * | 12/2011 | Imlach | B63G 8/24 114/331 |
| 8,136,470 | B1 * | 3/2012 | Buescher | B63G 8/14 114/121 |
| 8,193,406 | B2 | 6/2012 | D'Urso | |
| 8,741,158 | B2 | 6/2014 | Aytug | |
| 8,839,618 | B1 * | 9/2014 | Blottman, III | B63B 22/18 114/330 |
| 9,321,515 | B2 * | 4/2016 | Edwards | B63B 17/00 |
| 2004/0072485 | A1 | 4/2004 | Quigley | |
| 2006/0112860 | A1 | 6/2006 | Yoshitake | |
| 2008/0286556 | A1 | 11/2008 | D'Urso | |
| 2009/0042469 | A1 | 2/2009 | Simpson | |
| 2010/0294192 | A1 | 11/2010 | Herbek | |
| 2014/0094540 | A1 | 4/2014 | Simpson | |

OTHER PUBLICATIONS

Banister, Mark et al., "Molecular Engineering of Polymer Actuators for Biomedical and Industrial Use," Proceedings of SPIE 8340, Electroactive Polymer Actuators and Devices (EAPAD), 19 pages, Apr. 26, 2012.

Banister, Mark et al., "Molecular Engineering of Polymer Actuators for Biomedical and Industrial Use," Proceedings of the SPIE, Electroactive Polymer Actuators and Devices Conference, vol. 8340, 19 pages, Apr. 26, 2012.

European Patent Application No. 13157505.2, Extended European Search Report, 7 pages, dated Jul. 17, 2013.

Han, A. et al., "Effects of Surface Treatment of MCM-41 on Motions of Confined Liquids," Journal of Physics D: Applied Physics, vol. 40, pp. 5743-5746, 2007.

Han, A. et al., "Infiltration Pressure of a Nanoporous Liquid Spring Modified by an Electrolyte," J. Mater. Res., vol. 22, No. 3, pp. 644-648, Mar. 2007.

Kim, Taewan et al., "Electrically Controlled Hydrophobicity in a Surface Modified Nanoporous Carbon," Applied Physics Letters, vol. 98, pp. 053106-1-053106-3, 2011.

Lu Weiyi et al., "Effects of Electric Field on Confined Electrolyte in a Hexagonal Mesoporous Silica," The Journal of Chemical Physics, vol. 134, pp. 204706-1-204706-5, 2011.

Website for "Multifunctional Materials Research Laboratory," Jacobs School of Engineering, University of California, San Diego, http://mmrl.ucsd.edu/index.html, 8 pages, downloaded Mar. 1, 2013.

Wikipedia, "Hydrophobic Silica," 4 pages, downloaded Nov. 19, 2015.

* cited by examiner

FLUID-BASED BUOYANCY COMPENSATION

RELATED APPLICATIONS

This application is a divisional of U.S. patent application Ser. No. 13/782,971, entitled "Fluid-Based Buoyancy Compensation," filed on Mar. 1, 2013; which claims priority to U.S. Provisional Patent Application No. 61/645,399, entitled "Fluid-Based Buoyancy Compensation," filed on May 10, 2012, and to U.S. Provisional Patent Application No. 61/605,924, entitled "Fluid-Based Buoyancy Compensation," filed on Mar. 2, 2012, the contents of each of which are incorporated by reference in their entirety for all purposes.

TECHNICAL FIELD

Various embodiments of the present invention generally relate to fluid-based buoyancy compensation. More specifically, various embodiments of the present invention relate to systems and methods for a buoyancy control system using a compressible fluid in oceanographic or other applications including but not limited to scientific floats, submersibles, submarines, and buoys.

BACKGROUND

Underwater vehicles can be used for numerous applications. Some common examples include oil and gas exploration, inspection and building of subsea infrastructure (e.g., pipeline), military applications, scientific research, marine life discovery and tracking, and others. Depending on the application, these vessels can be completely or partially autonomous, non-autonomous, or remote controlled.

Current oceanographic and underwater vessels ascend and descend through the ocean by changing the overall buoyancy of the vessel. However, these traditional buoyancy compensation systems typically change the overall buoyancy of the vessel by pumping fluid or gas in and out of external bladders or sections of the vessel. These types of systems consume large amounts of energy and require complex, high-pressure hydraulic systems with pumps, filters, valves, controls, etc. As such, there are a number of challenges and inefficiencies found in traditional buoyancy compensation systems.

SUMMARY

Systems and methods are described for fluid-based buoyancy compensation. Various embodiments of the present invention relate to systems and methods for a buoyancy control system using a compressible fluid in oceanographic or other applications including but not limited to scientific floats, submersibles, submarines, and buoys. In traditional submersible vessels, the oil and air buoyancy systems are some of the most challenging hardware components and typically have the most issues. Embodiments of the present invention allow for these systems to be eliminated or simplified.

In some embodiments, a buoyancy compensation system may be used to maintain and/or adjust the depth of submersible vessel. For example, in some embodiments, the compressible fluid changes with depth/pressure to maintain an overall neutral buoyancy of the vessel. The compressible fluid can include any of the multiple component materials that utilize highly hydrophobic microparticles along with a fluid and/or other similar composite materials. In some embodiments, the compressibility of the compressible fluid can be adjusted using electrodes.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the scope of the present invention. Accordingly, the drawings and detailed description are to be regarded as illustrative in nature and not restrictive.

BRIEF DESCRIPTION OF THE DRAWINGS

Embodiments of the present invention will be described and explained through the use of the accompanying drawings in which.

Figure 1:
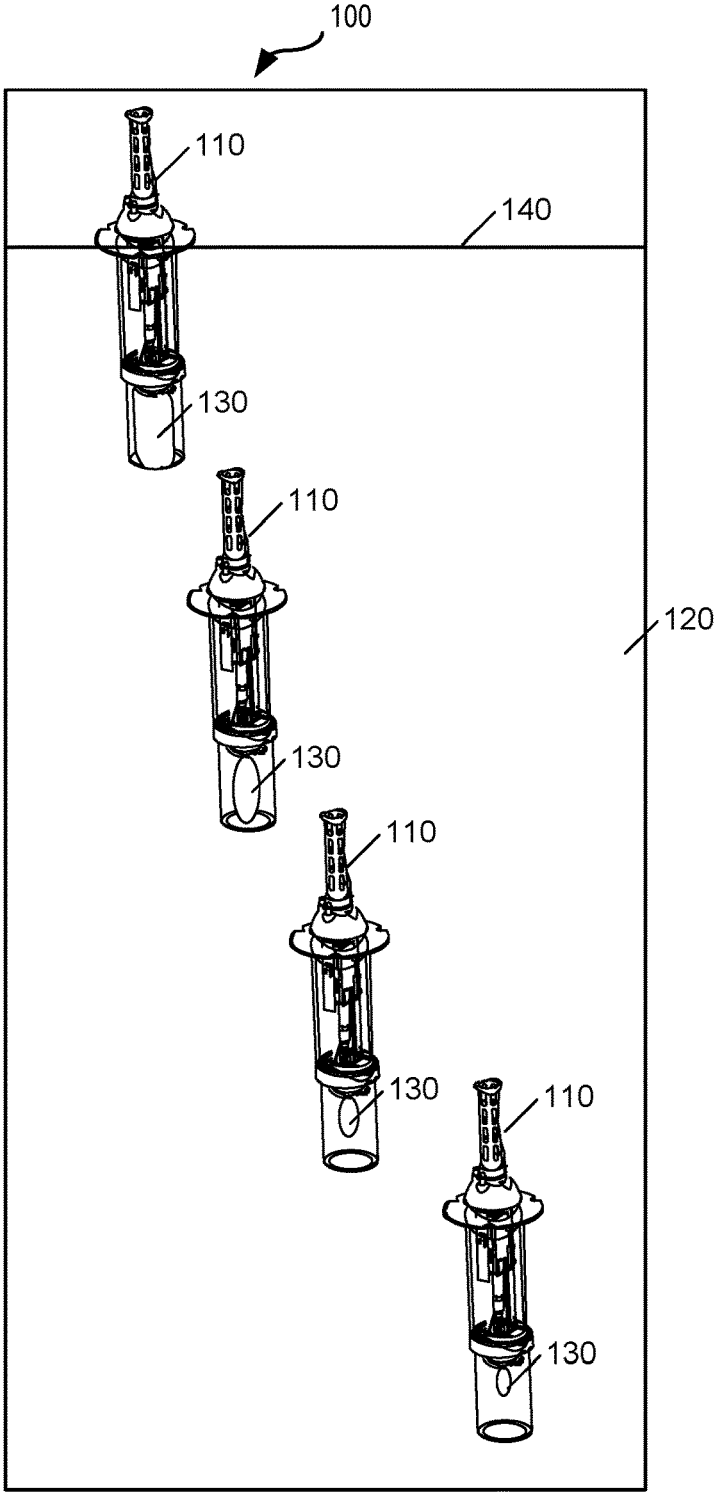
FIG. 1 is a schematic depicting a submersible vessel with a buoyancy compensation system descending in accordance with one or more embodiments of the present invention.

The drawings have not necessarily been drawn to scale. For example, the dimensions of some of the elements in the figures may be expanded or reduced to help improve the understanding of the embodiments of the present invention. Similarly, some components and/or operations may be separated into different blocks or combined into a single block for the purposes of discussion of some of the embodiments of the present invention. Moreover, while the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Various embodiments of the present invention generally relate to a fluid-based buoyancy control system for use in oceanographic or other underwater applications. Examples of underwater applications for which embodiments of the present invention may be utilized include, but are not limited to, scientific floats, submersibles, submarines, buoys, and other vessels. More specifically, various embodiments of the present invention relate to systems and methods of buoyancy compensation using a compressible mixture of water (or other liquid) and superhydrophobic powder, foam, or electrospun fibers. In some embodiments, the compressible mixture can be used to control the overall compressibility of an oceanographic vessel by altering the overall compressibility of an oceanographic vessel to match the compressibility of seawater. As a result, only a small amount of fluid needs to be pumped in or out of the vessel to make it ascend or descend. Still yet, in some embodiments, the compressibility of the fluid can be adjusted by changing a voltage between electrostatic plates.

Various techniques in the past have been implemented to tailor an oceanographic vessel's compressibility to match seawater. Most of these techniques, however, entail changing the flexibility or strength of an outer (e.g., carbon) hull. In contrast, embodiments of the present invention provide a much simpler, cost-effective method of achieving compressibility nearly matching seawater.

The use of these systems and techniques discussed herein allow the overall compressibility of a submersible oceanographic vessel to change. This change in compressibility results in the vessel ascending and descending in the body of water (e.g., ocean) while using less energy than traditional buoyancy control systems. In some embodiments, the system contains none of the traditional hydraulic components found in traditional buoyancy control systems. As a result, the complexity and energy usage of the buoyancy control system is improved.

The techniques introduced here can be embodied as special-purpose hardware (e.g., circuitry), or as programmable circuitry appropriately programmed with software and/or firmware, or as a combination of special-purpose and programmable circuitry. Hence, embodiments may include a machine-readable medium having stored thereon instructions which may be used to program a computer (or other electronic devices) to perform a process. The machine-readable medium may include, but is not limited to, floppy diskettes, optical disks, compact disc read-only memories (CD-ROMs), and magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions.

Terminology

Brief definitions of terms, abbreviations, and phrases used throughout this application are given below.

The terms "connected" or "coupled" and related terms are used in an operational sense and are not necessarily limited to a direct physical connection or coupling. Thus, for example, two devices may be coupled directly, or via one or more intermediary media or devices. As another example, devices may be coupled in such a way that information can be passed there between, while not sharing any physical connection with one another. Based on the disclosure provided herein, one of ordinary skill in the art will appreciate a variety of ways in which connection or coupling exists in accordance with the aforementioned definition.

The phrases "in some embodiments," "according to various embodiments," "in the embodiments shown," "in one embodiment," "in other embodiments," and the like generally mean the particular feature, structure, or characteristic following the phrase is included in at least one embodiment of the present invention, and may be included in more than one embodiment of the present invention. In addition, such phrases do not necessarily refer to the same embodiments or to different embodiments.

If the specification states a component or feature "may", "can", "could", or "might" be included or have a characteristic, that particular component or feature is not required to be included or have the characteristic.

The term "responsive" includes completely and partially responsive.

The term "module" refers broadly to software, hardware, or firmware (or any combination thereof) components. Modules are typically functional components that can generate useful data or other output using specified input(s). A module may or may not be self-contained. An application program (also called an "application") may include one or more modules, or a module can include one or more application programs.

General Description

FIG. 1 is a schematic depicting a submersible vessel 110 descending within a body of water 120 using a buoyancy compensation system in accordance with one or more embodiments of the present invention. As illustrated in FIG. 1, the submersible vessel 110 includes a container 130 with a compressible fluid (e.g., a highly compressible fluid or a variably compressible fluid) to move up and down in the water. In some embodiments, the compressible fluid compresses as pressure is applied or expands as pressure is released thereby maintaining an overall neutral buoyancy for vessel 110. This allows vessel 110 to ascend and descend to water depths with minimal active buoyancy change.

Container 130 may be a rubber bladder, bellow, piston, or other flexible or expandable container that can hold the compressible fluid. In some embodiments, flexible container 130 may be external to the main body of vessel and housed within a cowling. For example, in at least one embodiment, container 130 may be trapped inside the cowling, but not technically physically attached to vessel 110. In other embodiments, the flexible container 130 may be attached and/or located in a chamber within the vessel's hull. In addition, in specific fluid designs, an electrostatic field or voltage can be applied to increase or decrease the compressibility of the fluid within container 130 thus tuning properties of the compressible fluid in real time.

As illustrated in FIG. 1, the compressible fluid within the expandable container 130 is compressed as the depth of submersible vessel 110 increases. In accordance with various embodiments, the submersible vessel may have a depth range up to 5 or more miles below the surface 140 of the body of water 120. In some cases, embodiments of the present invention provide for a dramatic savings in energy. For vessels with limited fuel and power, minimizing consumption of these limited resources allows for longer deployment and/or smaller energy storage systems. In addition, the elimination (or simplification) of complex hydraulic systems that are expensive and prone to failure is also advantageous as this increases the ease of use, allows for smaller buoyancy subsystems, allows for easier handling, provides vessels with a higher reliability, and vessels with a longer-life.

Figure 2:
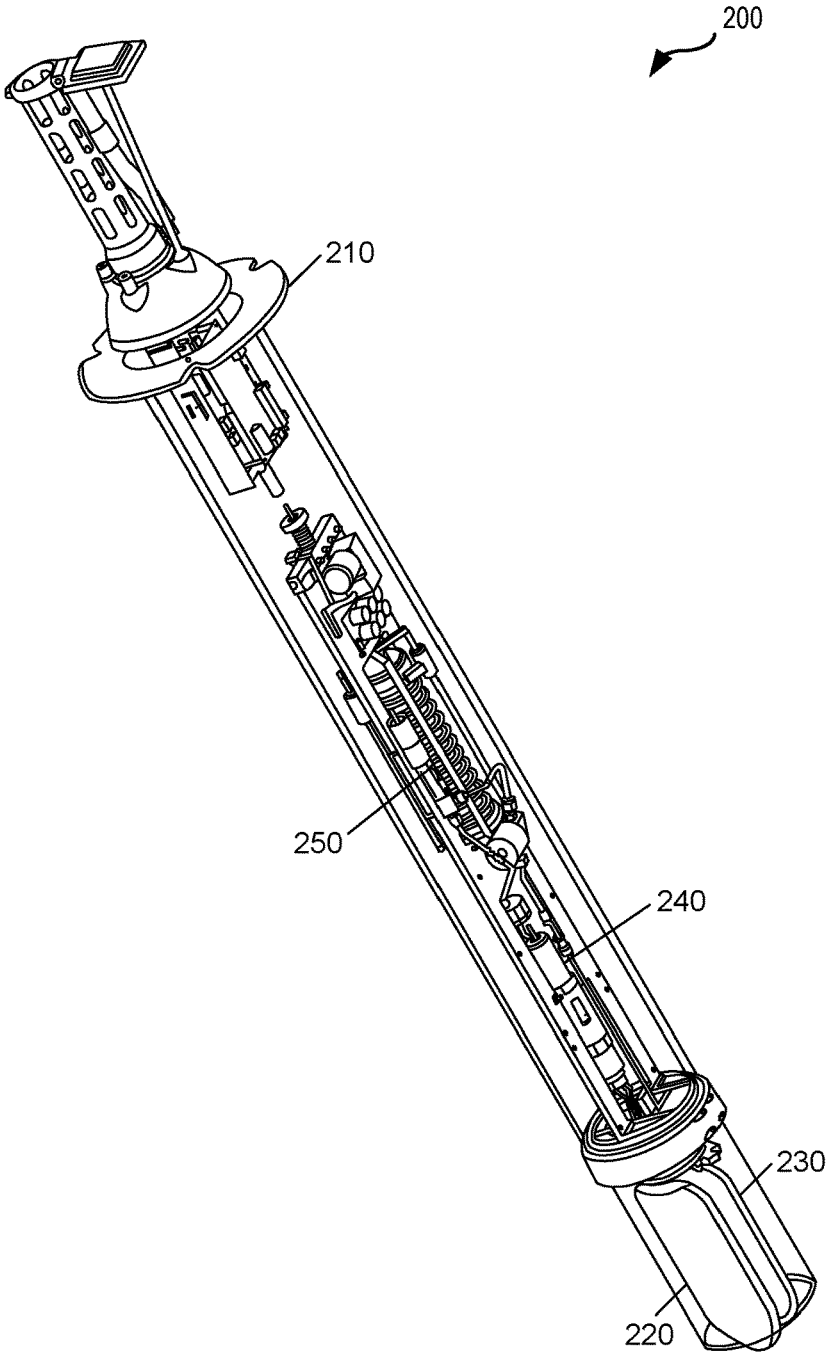
FIG. 2 is a schematic depicting a vessel with a buoyancy compensation system with a fluid-based subsystem and a secondary hydraulic-based subsystem in accordance with some embodiments of the present invention.

FIG. 2 is a schematic 200 depicting a vessel 210 with a buoyancy compensation system that includes a compressible fluid-based subsystem and a secondary active system in accordance with some embodiments of the present invention. In the embodiments illustrated, the compressible fluid-based subsystem includes an expandable container 220 as part of a passive buoyancy control system. Expandable container 220 is filled with a compressible fluid that changes volume as pressure is applied or removed (e.g., by vessel 210 ascending or descending within the body of water). As a result, the fluid compresses as pressure is applied and expands as pressure is released. This expansion and contraction passively changes the buoyancy of the vessel to substantially maintain a neutral buoyancy in the surrounding water. This passive system, when used with a secondary active system, dramatically improves the efficiency of vessel 210.

A secondary active system illustrated is a hydraulic system. However, other types of active systems can be used such as air systems or compressible fluids that have a variable compressibility (e.g., by applying a voltage) can be used in conjunction with the passive buoyancy system to fine tune or adjust the overall buoyancy. As such, some embodiments may have one, two, three, or more external containers. However, the requirements of the active system may be greatly reduced so that only a small amount of fluid or air, as compared to traditional systems, needs be pumped in and out of the second expandable container 230. As a result, in embodiments of the present invention, oil pump 240 can be a smaller pump to move a much smaller amount of oil from internal oil bladder 250.

As an example, some embodiments of the present invention use a mixture of liquid and solid (e.g., a water/hydroscopic powder mixture) that can have compressibility as high as twenty times that of water so only about four kilograms of this fluid may be required to tune the compressibility of a one-hundred kilogram vessel. The mixture makes the entire vessel match around ninety percent of the compressibility of water. This allows for the vessel to move ten percent as much oil as in traditional designs and reduces the vessel's energy consumption by a comparable amount.

In some embodiments, the mixture can include electrospun fibers instead of (or in addition to) the hydroscopic powder. In many cases, electrospun fibers can have desirable mechanical properties such as tensile modulus and strength to weight ratios. Continuous fibers can be deposited as a non-woven fibrous mat can be deposited using a process of electrospinning that uses an electrical charge to draw the fiber from a liquid polymer. The forces from an electric field are then used to stretch the fibers until the diameter shrinks to a desirable level (e.g., between 100 microns and 10 nanometers). Some embodiments of the present invention use fibers made out of Teflon (PTFE) and/or other hydrophobic materials. One advantage of the fibers is that the fibers will hold itself in place and not clump.

The surfaces of the fibers are typically rough to help enable compression. For example, on a small scale, consider an indent in the surface of a hydrophobic material. With no external pressure and the material immersed in water, the water would be near the surface of the hydrophobic material but go straight across the indent because of surface tension. With the water crossing the top of the indent, an air gap is essentially created between the water and the indent. Applying pressure, the water will slowly begin to be forced into the indent. The bending radius of the water's surface depends on the pressure. A pressure of 50 atm will be able to bend the water surface to a radius of approximately 3 e-8 m (30 nm). Consequently, for an indent that is 60 nm across and 30 nm deep the water will not actually be forced into the indent until the pressure is 50 atm (~750 PSI).

Various embodiments use electrospun fibers with a 50 nm diameter. The fibers may be partially or completely covered in indents. In some embodiments, the indents may be approximately 8 nm across and have a depth of 4 nm or more. The water will get close to the fiber but not fill the indents until the pressure increases. In some cases, the indents will only be filled at a few thousand PSI. The voids created by the indents can account for approximately 20% of the fiber volume in many embodiments. In other embodiments, the voids created by the indentations may account for more or less of the fiber volume. In some embodiments, with tightly packed indentation with minimal water the system can experience a compression of approximately 10%. In other embodiments, the compression amount may be more or less than 10%.

In one embodiment, the electrospun fibers may be sprayed into the bladder directly to form a fiber structure. Then, the water or other liquid can be forced into the bladder before the bladder is sealed. In other embodiments, the electrospun fibers can be generated in sheets outside of the bladder that can be cut or shredded into strips or pieces (e.g., approximately ¼ inch or ½ inch pieces). These pieces or strips can be placed into the bladder before forcing the water or other liquid into the bladder. In both cases, the amount of liquid forced into bladder sets the baseline for the buoyancy created by the passive system.

In addition to powders and electrospun fibers, some embodiments may use a foam material with hydrophopic properties. In various embodiments, the foam may be placed inside of an expandable container along with a liquid. In other embodiments, the foam may be placed directly inside a cowling of the vessel without the use of the expandable container or bladder. The water or seawater surrounding the vessel may enter though openings within the cowling. The surrounding pressure from the water will force the water into or out of the foam material thereby changing the buoyancy of the vessel. In some embodiments, the foam will be larger than the openings within the cowling and can be left unattached to the vessel. In other embodiments, the foam may be securely affixed to the vessel or cowling through the use of adhesives, bolts, screws, epoxies, or other attaching mechanisms.

Figure 3:
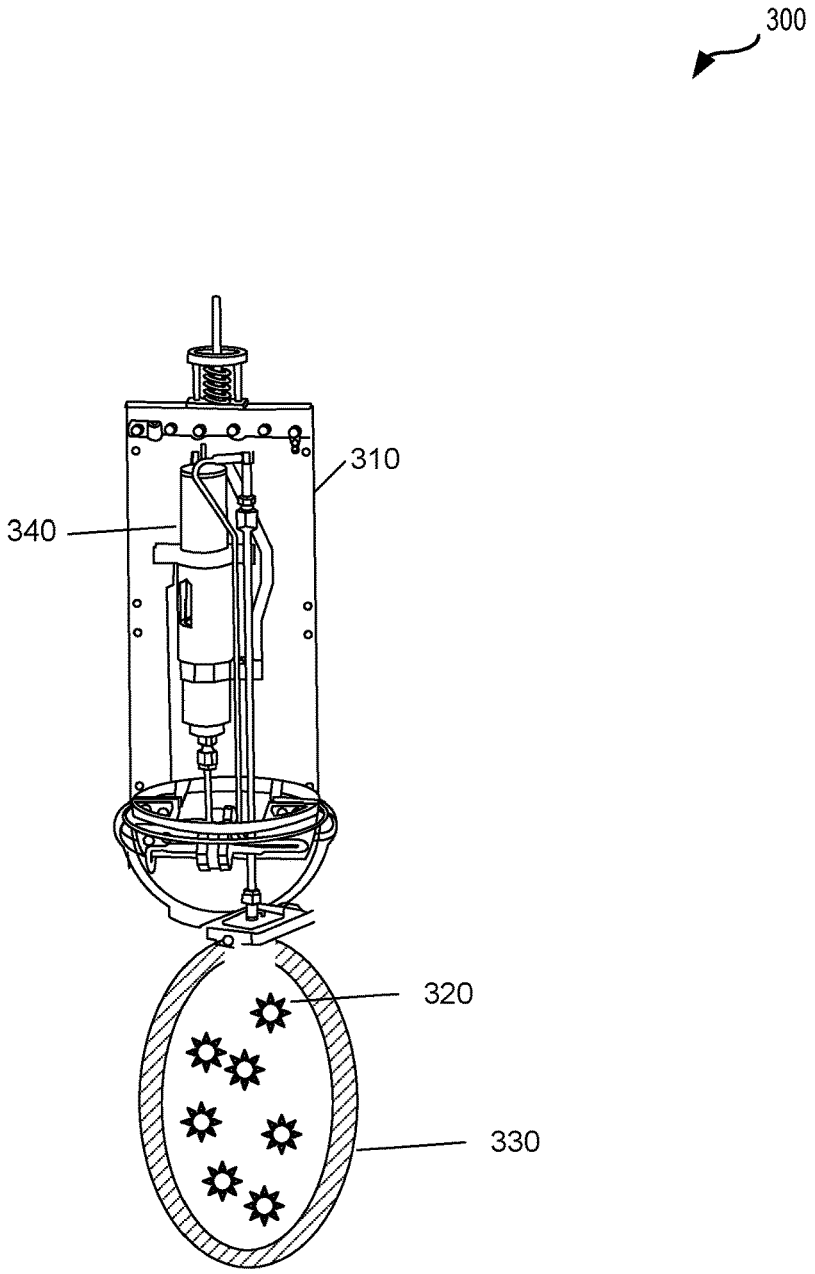
FIG. 3 is a schematic showing a vessel with a fluid-based compensation system that uses a compressible fluid that includes a mixture of nanoporous particles and a liquid according to various embodiments.

FIG. 3 is a schematic showing a vessel 310 with a fluid-based compensation system that uses a compressible fluid that includes mixture of nanoporous particles 320 and a liquid according to various embodiments of the present invention. Submersible vessel 310 includes a flexible bladder 330 filled with the compressible fluid. The compressible fluid can be composed of a liquid along with a porous hydrophobic powder, electronspun fibers, foam, or other material with the desirable properties. In the embodiments illustrated, the buoyancy compensation system of vessel 310 does not rely on an oil-based or air-based system. Instead, pump 340 is used to adjust the amount of compressible fluid within flexible bladder 330.

Figure 4:
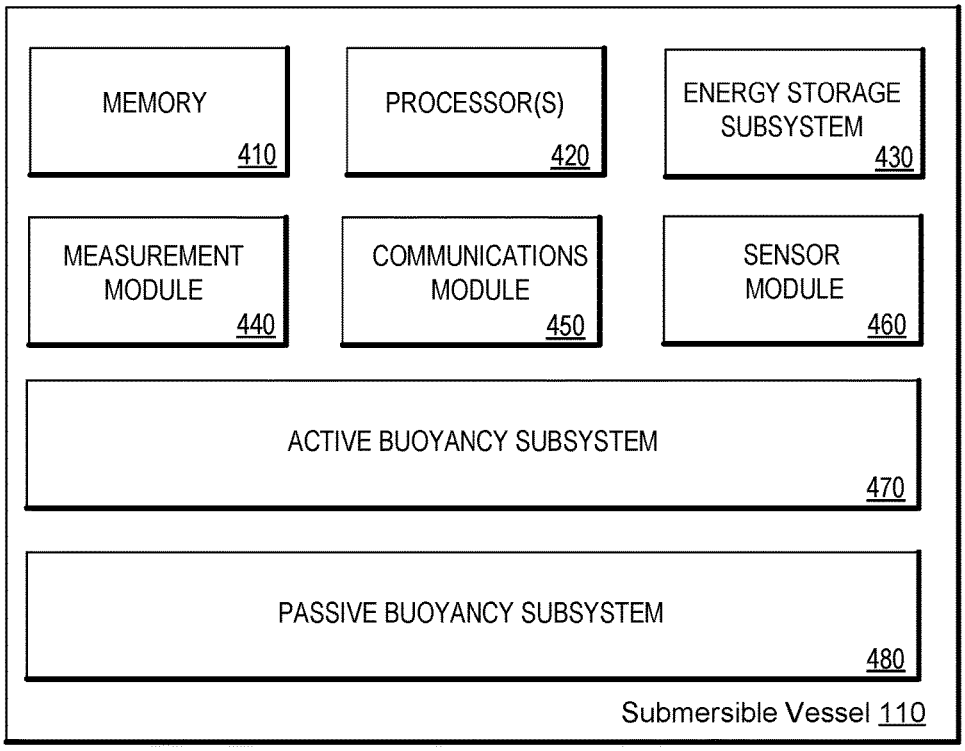
FIG. 4 shows a block diagram with exemplary components of submersible vessel in accordance with one or more embodiments of the present invention.

FIG. 4 shows a block diagram with exemplary components of submersible vessel 110 in accordance with one or more embodiments of the present invention. According to the embodiments shown in FIG. 4, submersible vessel 110 can include memory 410, one or more processors 420, energy storage subsystem 430, measurement module 440, communications module 450, sensor module 460, active buoyancy subsystem 470, and passive buoyancy subsystem 480. Other embodiments of the present invention may include some, all, or none of these modules and components along with other modules, engines, interfaces, applications, and/or components. Still yet, some embodiments may incorporate two or more of these elements into a single module and/or associate a portion of the functionality of one or more of these elements with a different element. For example, in one embodiment, passive buoyancy subsystem 480 may be included as part of active buoyancy subsystem 470.

Memory 410 can be any device, mechanism, or populated data structure used for storing information. In accordance with some embodiments of the present invention, memory 410 can encompass any type of, but is not limited to, volatile memory, nonvolatile memory and dynamic memory. For example, memory 410 can be random access memory, memory storage devices, optical memory devices, media magnetic media, floppy disks, magnetic tapes, hard drives, SIMMs, SDRAM, DIMMs, RDRAM, DDR RAM, SODIMMS, erasable programmable read-only memories (EPROMs), electrically erasable programmable read-only memories (EEPROMs), compact disks, DVDs, and/or the like. In accordance with some embodiments, memory 410 may include one or more disk drives, flash drives, one or more databases, one or more tables, one or more files, local cache memories, processor cache memories, relational databases, flat databases, and/or the like. In addition, those of ordinary skill in the art will appreciate many additional devices and techniques for storing information which can be used as memory 410.

Memory 410 may be used to store instructions for running one or more modules, engines, interfaces, and/or applications on processor(s) 420. For example, memory 410 could be used in one or more embodiments to house all or some of the instructions needed to execute the functionality of measurement module 440, communications module 450, and/or sensor module 460. In addition, memory 410 may be used for controlling or interfacing with one or more components or subsystems such as energy storage system 430, active buoyancy subsystem 470, and/or passive buoyancy subsystem 480.

Energy storage subsystem 430 can include various components to provide energy to the different modules, engines, interfaces, applications, and/or components of the vessel. For example, in some embodiments energy storage subsystem 430 can include batteries (e.g., Electrochem $CSC_{93}$ DD Lithium Metal cells), solar panels for harvesting energy, and/or other fuel. By using the systems and techniques disclosed herein, the amount of energy required by the vessel can be substantially reduced over traditional systems. As a result, the number of battery cells or amount of fuel storage may be reduced for similar length voyages.

Measurement module 440 includes instrumentation for the measurement of various environmental parameters. For example, in some embodiments, measurement module may use various instruments to measure temperature, salinity and pressure in a vertical column from 2000 m depth to the surface. In some embodiments, measurement module 440 can include a GPS for determining current location of the vessel. The measurements can be stored in memory 410 and/or transferred to a base station using communications module 450.

Sensor module 460 monitors the state of the vessel including the functionality of internal and external components. Any abnormal results can be communicated to a base station using communications module 460 in real-time or on a predetermined reporting schedule. In some embodiments, sensor module 460 can include a supervisory control system that allows for the prioritization of different tasks based on the limited vessel resources. For example, sensor module 460 can monitor the energy usage of the vessel and, based on task prioritization, make any changes needed to keep from depleting the energy.

Submersible vessel 110 can also include active buoyancy subsystem 470 and/or passive buoyancy subsystem 480. These subsystems can include a number of different components and configurations as described herein. Various embodiments use a compressible fluid with a hydrophobic powder that can be made in many different ways. For example, a material that is naturally hydrophobic or one that is not but is coated to make it hydrophobic may be used. The coating process can be a gas deposition, plasma process or chemical process.

The physical structure of the powder can be rough like a spiked ball or a honeycomb. The powder particles are small—nanometers to microns—with the structure on the same scale. Some embodiments use the spiked ball structure with spikes that are significantly larger than the diameter of the ball. One advantage of this type of spiked ball structure is that large spikes allow for a space to be created if the particles were to clump together. With this space created by the spikes, a fluid is still able to go between the balls at a much lower pressure than when the large spikes are absent and clumping has occurred.

For the mixture, water or water mixtures can be used. Some embodiments increase the viscosity by adding various chemicals. A fluid with a higher viscosity would be able to operate to higher pressures. Various embodiments of the present invention provide for pressure ranges from 0 PSI to over 3000 PSI. In some embodiments, MCM-41 (Mobil Composition of Matter No. 41) can be used to create the compressible fluid. MCM-41, although composed of amorphous silica wall, possesses long range ordered framework with uniform mesopores. The pore diameter can be controlled within mesoporous range between 1.5 to 20 nm by adjusting the synthesis conditions and/or by employing surfactants with different chain lengths in their preparation.

Variations on the mixture can be made such that the compression only occurs at a specific pressure, uniformly over a large range in pressures, or a mixture of the two. The passive mixture can use water, saltwater, electrolytes, or other water mixtures. The electrically controlled system would also in an electrolyte (saltwater) as part of the mixture.

Figure 5A:
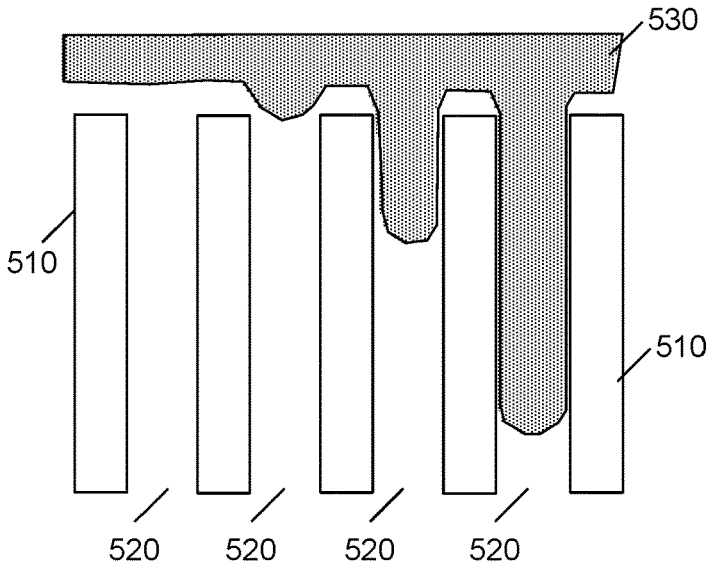
FIGS. 5A and 5B illustrate how the nanoporous material used within the buoyancy compensation system behaves in accordance with various embodiments of the present invention.
Figure 5B:
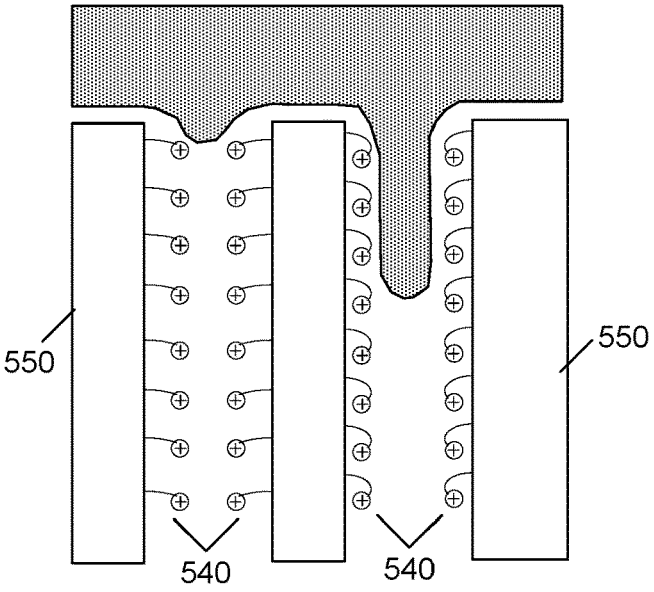

FIGS. 5A and 5B illustrate how the nanoporous material used within the buoyancy compensation system behaves in accordance with various embodiments of the present invention. FIG. 5A illustrates the basic working principle of the compressible fluid. The porous material 510 includes openings or pores 520. The porous material has a high hydrophobicity so that liquid 530 can not enter the pores at low pressure (far left). As the pressure increases (highest pressure at right) the liquid is forced closer to the nanoporous material and into the pores 520 thus resulting in an overall lower volume. FIG. 5B illustrates an electrostaticly controlled compressible material that has a nanoporous material with a controllable hydrophobicity. As shown, by adjusting a voltage, the molecular chains on the pore walls 550 bend or straighten to modify the hydrophobicity of the material and thus control the overall compressibility.

Figure 6:
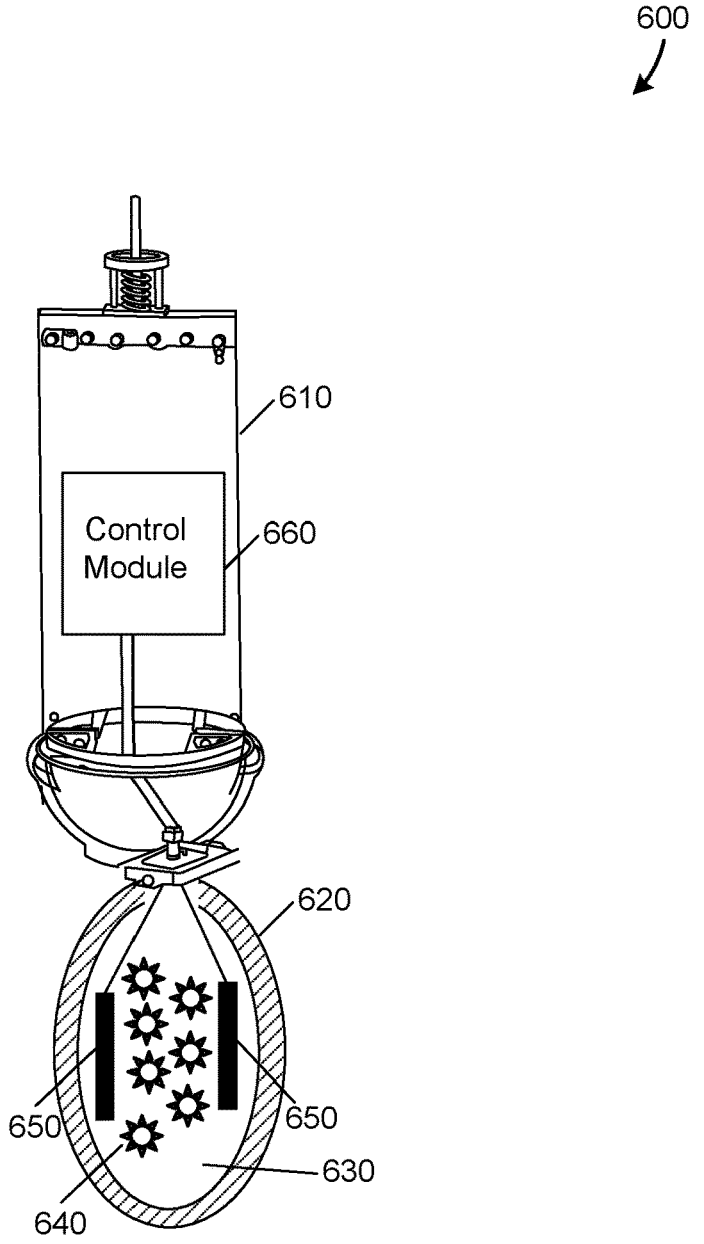
FIG. 6 is a schematic illustrating exemplary components used for adjusting the compressibility of a compressible fluid in accordance with some embodiments of the present invention.

For the electrically controlled compressible fluid, the mixture is similar to the one used for the passive system. The powder, however, is compressed into a more rigid overall structure. The electric field is produced by putting a voltage across two plates embedded in the mixture. In many embodiments, the voltage required is small. This enables the voltage to be provided by batteries and/or through a standard voltage control circuit in many embodiments. By adjusting the voltage the fluid becomes more or less compressible. As illustrated in FIG. 6, the buoyancy of the vessel is electrically controlled through the electrodes. As a result there is no longer a need for a mechanical pump resulting in a solid-state buoyancy compensation system.

FIG. 6 is a schematic illustrating exemplary components used for adjusting the compressibility of a compressible fluid in accordance with some embodiments of the present invention. FIG. 6 includes submersible vessel 610 with an attached flexible bladder 620 filled with a compressible fluid 630 composed of an electrically activated porous hydrophobic powder 640 and a liquid. The compressibility of fluid 630 in this case is controlled by adjusting the voltage across electrostatic plates 650 using control module/electronics 660. The electrodes 650 change the hydrophobicity of the material and its compressibility. Control module 660 allows for active expansion and contraction of the mixture thus changing the overall buoyancy of vessel 610 resulting in the vessel ascending and/or descending.

In some embodiments, an electrically controlled polymer (or polymer gel) may be used within the attached flexible bladder 620. The electrically controlled polymer may be used with or without the powder. When a voltage from electrodes 650 is applied to the polymer, the polymer will expand or contract by absorbing or expelling fluid. As a result, the overall buoyancy of submersible vessel 610 can be adjusted. Various properties of the polymer, such as, porosity, density, and surface area can influence the polymer's ability to absorb or expel the fluid. For example, the more porous the polymer the faster the polymer will be able to absorb or expel the fluid.

Figure 7:
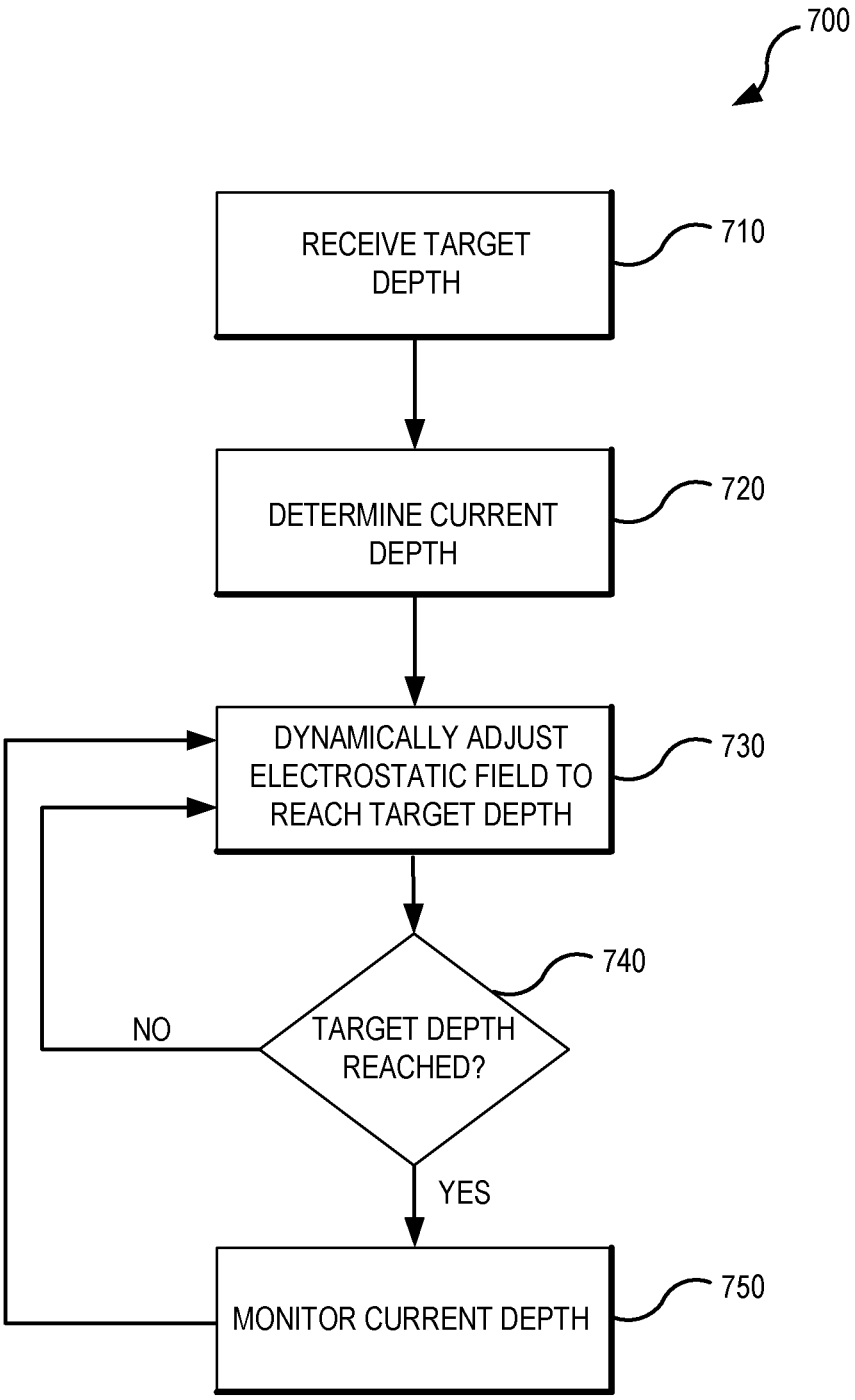
FIG. 7 is a flow chart illustrating exemplary operations for adjusting the buoyancy of a vessel in accordance with one or more embodiments of the present invention.

FIG. 7 is a flow chart illustrating exemplary operations 700 for adjusting the buoyancy of a vessel in accordance with one or more embodiments of the present invention. In accordance with various embodiments, one or more of these operations can be performed by, or using, communications module 450, sensor module 460, active buoyancy subsystem 470, and/or passive buoyancy subsystem 480. As illustrated in FIG. 7, receiving operation 710 receives a target depth for the vessel. The target depth could be based on a planned trajectory stored within memory 410 or received through communications module 450.

Once the target depth is received, a current depth of the vessel is determined during determination operation 720. In accordance with various embodiments, determination operation 720 may be executed on demand and/or on a periodic schedule to minimize power usage. Using the current depth (and possibly one or more other factors such as water temperature, current rate of descent/ascent, water salinity, etc.) adjustment operation 730 dynamically adjusts an electrostatic field to reach the target depth received by receiving operation 710.

Decision operation 740 determines if the target depth has been reached. If decision operation determines that the target depth has not been reached, then decision operation branches to adjustment operation 730. If decision operation 740 determines that the vessel has reached the target depth, then decision operation 740 branches to monitoring operation 750. Monitoring operation 750 continues to monitor the current depth (e.g., continuously, periodically, or on a predetermined schedule). When monitoring operation determines that the vessel is not within a tolerance range of the target depth, monitoring operation branches to adjustment operation 730 where the electrostatic field is adjusted in order to maintain the desired target depth.

In conclusion, the present invention provides novel systems, methods and arrangements for buoyancy compensation. While detailed descriptions of one or more embodiments of the invention have been given above, various alternatives, modifications, and equivalents will be apparent to those skilled in the art without varying from the spirit of the invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof. Therefore, the above description should not be taken as limiting the scope of the invention, which is defined by the appended claims.

What is claimed is:

1. A method comprising:

receiving a target depth for a submersible vessel;

determining, using a sensor module, a current depth of the submersible vessel;

adjusting, based on the current depth and the target depth, the buoyancy of the submersible vessel using a compressible fluid within an expandable container, wherein the compressible fluid comprises a porous hydrophobic powder.

2. The method of claim 1, wherein the hydrophobic powder is an electrically activated porous hydrophobic powder and wherein adjusting the buoyancy comprises applying an electrostatic field to the compressible fluid.

3. The method of claim 2, wherein the compressible fluid has a compressibility profile and the method further comprises determining a voltage of the electrostatic field resulting in a desired compressibility of the fluid.

4. The method of claim 1, wherein adjusting the buoyancy of the submersible vessel includes using a pump to adjust an amount of the compressible fluid within the expandable container.

5. The method of claim 1, further comprising:

recording measurements of a liquid surrounding the submersible vessel; and communicating, using a communications module, the measurements of the liquid to a remote base station.

6. The method of claim 5, wherein the measurements of the surrounding liquid includes measurements of salinity, temperature, or pressure.

7. A method comprising:

receiving a target depth for a submersible vessel;

determining, using a sensor module, a current depth of the submersible vessel;

adjusting, based on the current depth and the target depth, the buoyancy of the submersible vessel using a compressible fluid within an expandable container, wherein the compressible fluid comprises hydrophobic electrospun fibers.

8. A method comprising:

receiving a target depth for a submersible vessel;

determining, using a sensor module, a current depth of the submersible vessel;

adjusting, based on the current depth and the target depth, the buoyancy of the submersible vessel using a compressible fluid within an expandable container, wherein the compressible fluid comprises hydrophobic foam.

* * * * *